US011142936B2

(12) United States Patent
Leng

(10) Patent No.: US 11,142,936 B2
(45) Date of Patent: Oct. 12, 2021

(54) STORAGE CABINET

(71) Applicant: New-Tec Integration (Xiamen) Co., Ltd., Xiamen (CN)

(72) Inventor: Luhao Leng, Xiamen (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 0 days.

(21) Appl. No.: 16/794,169

(22) Filed: Feb. 18, 2020

(65) Prior Publication Data

US 2020/0263473 A1 Aug. 20, 2020

(30) Foreign Application Priority Data

Feb. 18, 2019 (CN) ..... 201920206355.4

(51) Int. Cl.
*E05F 5/10* (2006.01)

(52) U.S. Cl.
CPC ..... *E05F 5/10* (2013.01); *E05Y 2900/20* (2013.01)

(58) Field of Classification Search
CPC ..... E05F 5/10; E05F 1/1091; E05Y 2900/20; E05Y 2201/624; A47B 67/00
See application file for complete search history.

(56) References Cited

U.S. PATENT DOCUMENTS 4,899,420 A * 2/1990 Bye ..... E05D 7/121 16/16
5,116,274 A * 5/1992 Artwohl ..... A47F 3/007 312/116
5,967,392 A * 10/1999 Niemi ..... B60R 9/00 16/289
10,907,393 B2 * 2/2021 Leng ..... E05F 1/1091
2005/0211140 A1 * 9/2005 McDonald, II ..... A47B 46/005 108/108
2006/0005468 A1 * 1/2006 McCullough ..... E05F 1/1075 49/387
2012/0199600 A1 * 8/2012 Anderson ..... A47C 7/62 220/810
2015/0123530 A1 * 5/2015 Boewe ..... A47B 47/025 312/327
2018/0229886 A1 * 8/2018 Jiang ..... B65D 25/2897

* cited by examiner

*Primary Examiner* — Matthew W Ing
(74) *Attorney, Agent, or Firm* — Cooper Legal Group, LLC

(57) ABSTRACT

A storage cabinet a cabinet body with a top opening, an upper cover, and two support elements is provided. Each of the two support elements is connected between the upper cover and the cabinet body. Each of the two support elements comprises a pneumatic bar, an upper cover connector, a cabinet body connector, and a swing piece. The upper cover connector is connected to a side of the upper cover, and the cabinet body connector is connected to a side of the cabinet body. A first end of the upper cover connector is pivotally connected to a first end of the cabinet body connector, and a first end of the swing piece is pivotally connected to the cabinet body connector. Two ends of the pneumatic bar are respectively connected to a second end of the swing piece and a second end of the upper cover connector.

17 Claims, 5 Drawing Sheets

STORAGE CABINET

RELATED APPLICATIONS

This application claims priority to Chinese Patent Application 201920206355.4, filed on Feb. 18, 2019, which is incorporated herein by reference.

FIELD OF THE DISCLOSURE

The present disclosure relates to a cabinet, and in particular relates to a storage cabinet having a positionable upper cover.

BACKGROUND OF THE DISCLOSURE

Storage cabinets, also referred to herein as cabinets, are usually a hollow, rectangular-shaped or square-shaped box structure, and a top surface of the cabinets is configured to be opened and closed freely, thereby functioning as an upper cover. Traditional storage cabinets comprise no position assemblies for keeping the upper cover at a set position upon being opened. When the upper cover is opened, the upper cover is rotated to a back side of the cabinets and hangs down naturally. Therefore, a degree to which the upper cover rotates when being opened or closed is large, and opening or closing the upper cover is laborious. Even when a cabinet is small, the cabinet can barely be operated by a person standing in front of the cabinet. When a cabinet is large, the arms of a person standing in front of the cabinet are not long enough to directly operate the cabinet. Instead, the person needs to move to a side of the cabinet to open or close the upper cover, and therefore the operation is not convenient. In order to open the upper cover of large-sized cabinets conveniently, some people have created storage cabinets with position assemblies for opening the upper cover. However, the existing cabinets simply use a support rod to support the opened upper cover. If the upper cover is accidently touched, the support rod easily falls down, and the upper cover falls down too due to the lack of support. The upper cover can hurt the user when falling, or an impact force of the falling upper cover can be great enough to cause a connection between the upper cover and the cabinet to break.

BRIEF SUMMARY OF THE DISCLOSURE

The present disclosure provides a storage cabinet having a positionable upper cover and a stable structure to solve deficiencies of the background techniques. In order to solve the aforementioned technical problems, a technical solution of the present disclosure is as follows.

A storage cabinet comprises a cabinet body with a top opening, an upper cover configured to cover the top opening, and two support elements. The two support elements are respectively symmetrically disposed on a left side and a right side of the cabinet body. Each of the two support elements is connected between the upper cover and the cabinet body. Each of the two support elements comprises a pneumatic bar, an upper cover connector, a cabinet body connector, and a swing piece. The upper cover connector is fixedly connected to a side of the upper cover, the cabinet body connector is fixedly connected to a side of the cabinet body. A first end of the upper cover connector is pivotally connected to a first end of the cabinet body connector, and a first end of the swing piece is pivotally connected to the cabinet body connector. Two ends of the pneumatic bar are respectively connected to a second end of the swing piece and a second end of the upper cover connector.

In another preferred embodiment, a pin is disposed on a middle portion of the swing piece, and an arc-shaped positioning hole is disposed in the cabinet body connector. The pin extends from the middle portion of the swing piece and into the arc-shaped positioning hole.

In another preferred embodiment, when the pneumatic bar retracts, the pin moves to an upper end of the arc-shaped positioning hole, and the upper cover closes. When the pneumatic bar extends, the pin moves to a lower end of the arc-shaped positioning hole, and the upper cover opens.

In another preferred embodiment, the cabinet body connector of a first support element of the two support elements is disposed on a rear end of a left board of the cabinet body and the cabinet body connector of a second support element of the two support elements is disposed on a rear end of an upper edge of a right board of the cabinet body. A rear end of the cabinet body connector extends backward to a back side of a rear board of the cabinet body to define a transition portion, and the transition portion is pivotally connected to the upper cover connector.

In another preferred embodiment, the upper cover connector of the first support element is connected to a left side of a frame of the upper cover and the upper cover connector of the second support element is connected to a right side of the frame.

In another preferred embodiment, the pneumatic bar comprises a housing and a movable rod. A lower end of the housing is pivotally connected to the second end of the swing piece, and an upper end of the movable rod is pivotally connected to the second end of the upper cover connector.

In another preferred embodiment, the pneumatic bar is disposed in the storage cabinet.

In another preferred embodiment, the cabinet body comprises a bottom board, a left board, a right board, a front board, and a rear board.

Compared with the background art, this technical solution has the following advantages:

1. A pair of support elements is disposed between the cabinet body and the upper cover. Each support element of the pair of support elements comprises an upper cover connector and a cabinet body connector. The upper cover connector and the cabinet body connector are respectively fixedly connected to the upper cover and the cabinet body. The upper cover connector is pivotally connected to the cabinet body, and the upper cover connector and the cabinet body connector are connected by a pneumatic bar and a swing piece. The upper cover connector, the cabinet body connector, the swing piece, and the pneumatic bar define a four link rod structure.

When the upper cover is opened or closed, the upper cover connector rotates synchronously, the swing piece swings and provides space to the pneumatic bar, the pneumatic bar extends or retracts correspondingly, and the pneumatic bar can stably support the upper cover. In this way, the upper cover is stably opened or closed.

2. A pin is disposed on a middle portion of the swing piece, and an arc-shaped positioning hole is disposed in the cabinet body connector. The pin is disposed in the arc-shaped positioning hole. The pin cooperates with the arc-shaped positioning hole to define a maximum angle for opening the upper cover.

3. The upper cover is not directly pivotally connected to the cabinet body, but the cabinet body connector is pivotally connected to the upper cover connector. Therefore, a structure of the upper cover and the cabinet body is simplified.

BRIEF DESCRIPTION OF THE DRAWING

The present disclosure will be further described below with the combination with the accompanying drawings and the embodiments.

DETAILED DESCRIPTION OF THE EMBODIMENTS

Embodiment 1

Figure 1:
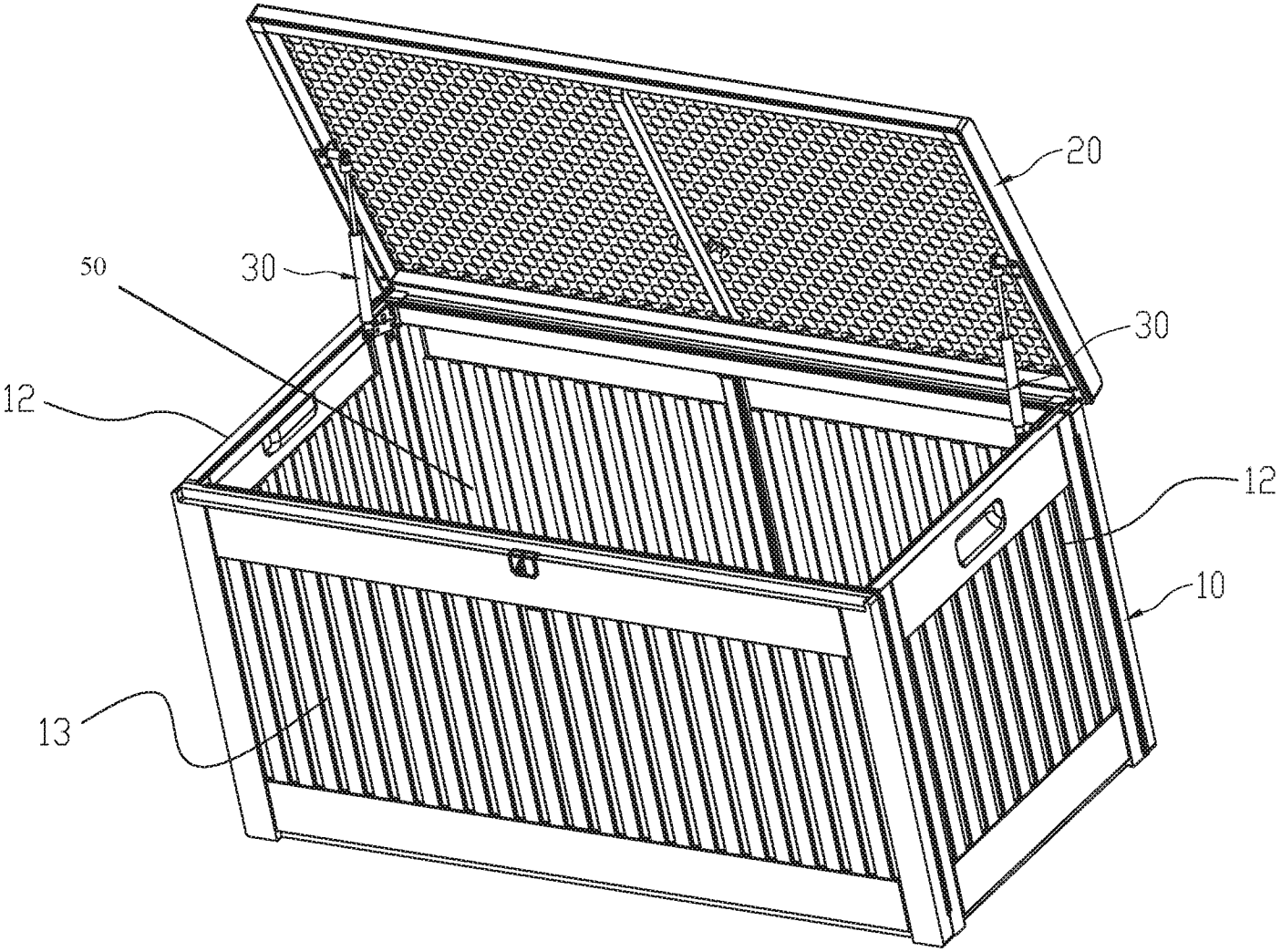
FIG. 1 illustrates a perspective schematic view of the storage cabinet with the positionable upper cover of Embodiment 1 of the present disclosure.
Figure 2:
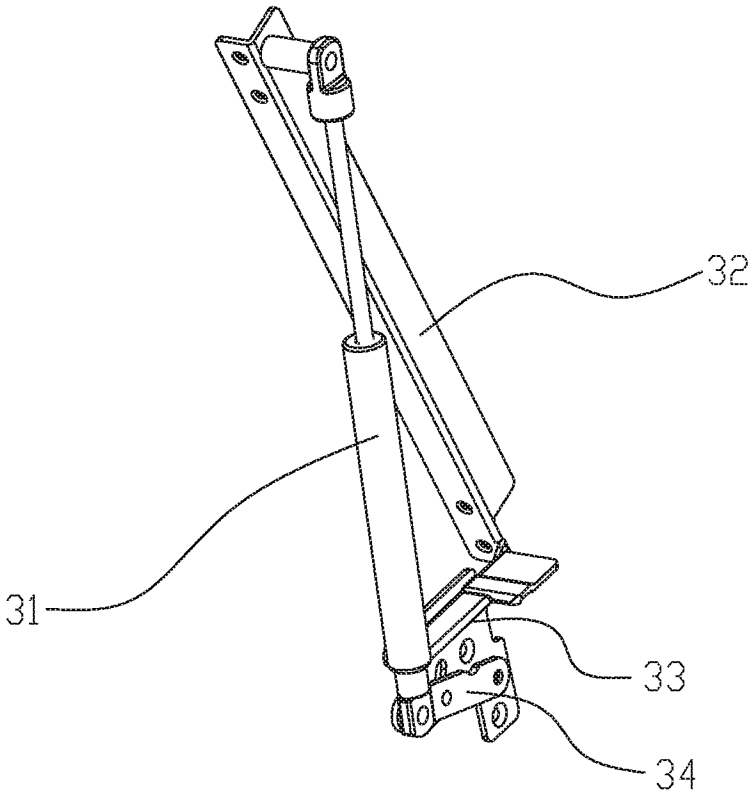
FIG. 2 illustrates a first schematic view of a support element of the storage cabinet with the positionable upper cover shown in FIG. 1.
Figure 3:
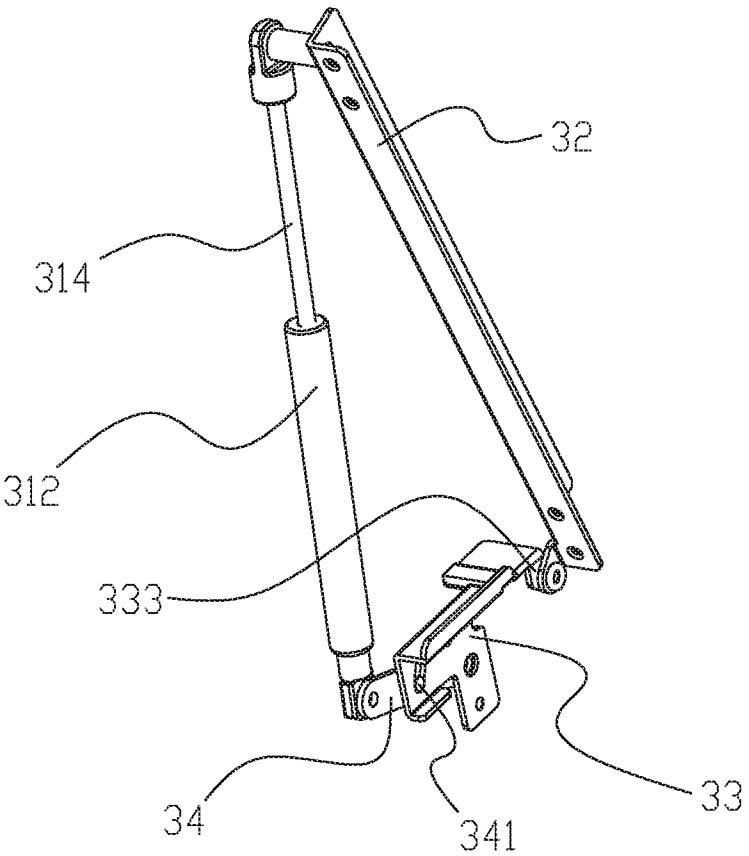
FIG. 3 illustrates a second schematic view of the support element of the storage cabinet with the positionable upper cover shown in FIG. 1.

Referring to FIGS. 1-5, a storage cabinet with a positionable upper cover comprises a cabinet body 10 with a top opening 50, an upper cover 20 configured to cover the top opening 50, and two support elements 30. The cabinet body 10 comprises a bottom board 11, a left board 12, a right board 12, a front board 13, and a rear board 14. The two support elements 30 are respectively symmetrically disposed on a left side and a right side of the cabinet body 10. Each of the two support elements 30 is connected between the upper cover 20 and the cabinet body 10. Each of the two support elements 30 comprises a pneumatic bar 31, an upper cover connector 32, a cabinet body connector 33, and a swing piece 34. The upper cover connector 32 is fixedly connected to a side of the upper cover 20, and the cabinet body connector 33 is fixedly connected to a side of the cabinet body 10. A first end of the upper cover connector 32 is pivotally connected to a first end of the cabinet body connector 33, and a first end of the swing piece 34 is pivotally connected to the cabinet body connector 33. Two ends of the pneumatic bar 31 are respectively connected to a second end of the swing piece 34 and a second end of the upper cover connector 32. The pneumatic bar 31, the upper cover connector 32, the cabinet body connector 33, and the swing piece 34 define a four link rod structure. The pneumatic bar 31 extends and retracts, and the swing piece 34 swings, so that an angle between the upper cover connector 32 and the cabinet body connector 33 varies.

Figure 4:
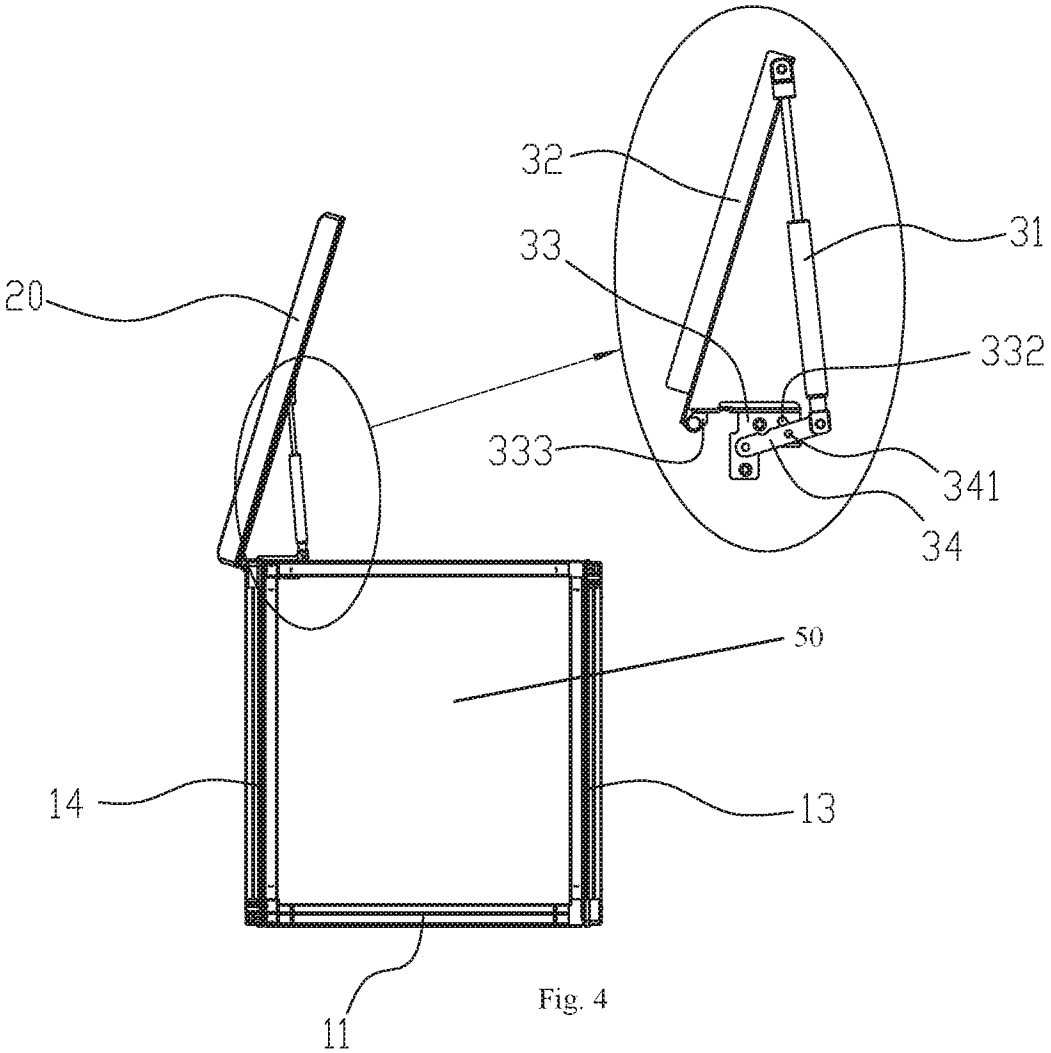
FIG. 4 illustrates a side view of the storage cabinet with the positionable upper cover shown in FIG. 1.
Figure 5:
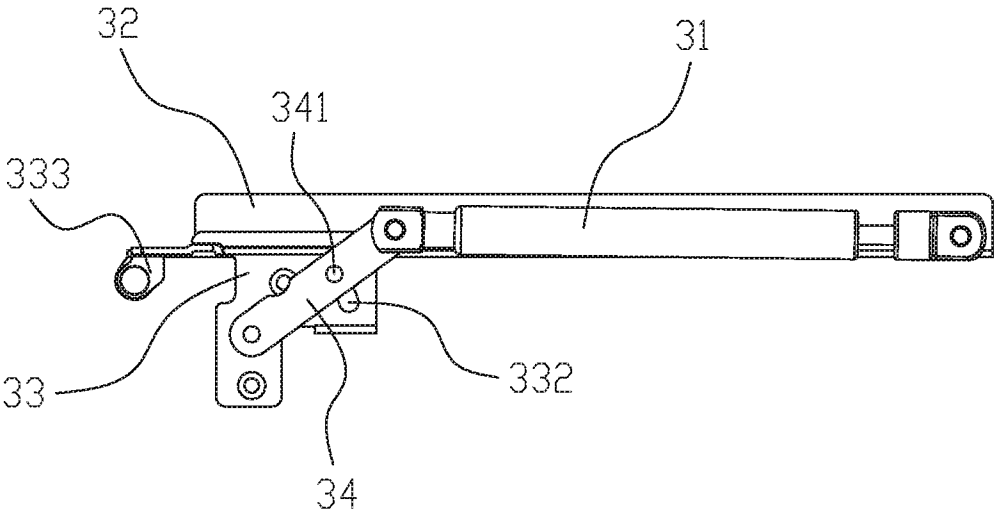
FIG. 5 illustrates a schematic view of the pneumatic bar of the storage cabinet with the positionable upper cover shown in FIG. 1 when the pneumatic bar is retracted.

A pin 341 is disposed on a middle portion of the swing piece 34, and an arc-shaped positioning hole 332 is disposed in the cabinet body connector 33. The pin 341 extends from the middle portion of the swing piece and into the arc-shaped positioning hole 332. When the pneumatic bar 31 retracts, the pin 341 moves to an upper end of the arc-shaped positioning hole 332, and the upper cover 20 concurrently closes (as shown in FIG. 5). When the pneumatic bar 31 extends, the pin 341 moves to a lower end of the arc-shaped positioning hole 332, and the upper cover 20 concurrently opens (as shown in FIG. 4).

The cabinet body connector 33 of a first support element 30 of the two support elements 30 is disposed on a rear end of an upper edge of the left board 12 and the cabinet body connector 33 of a second support element 30 of the two support elements 30 is disposed on a rear end of an upper edge of the right board 12 of the cabinet body 10. A rear end of the cabinet body connector 33 extends backward to a back side of the rear board 14 to define a transition portion 333. The transition portion 333 is pivotally connected to the upper cover connector 32. The upper cover connector 32 of the first support element 30 is connected to a left side of a frame of the upper cover 20 and the upper cover connector 32 of the second support element 30 is connected to a right side of the frame of the upper cover 20.

The pneumatic bar 31 comprises a housing 312 and a movable rod 314. A lower end of the housing 312 is pivotally connected to the second end of the swing piece 34, and an upper end of the movable rod 314 is pivotally connected to the second end of the upper cover connector 32. The pneumatic bar 31 is disposed in the storage cabinet.

Although the present disclosure has been described with reference to the preferred embodiments, it will be apparent to those skilled in the art that various modifications and variations can be made in the present disclosure without departing from the spirit or scope of the invention. Thus, it is intended that the present disclosure cover the modifications and variations of this invention provided they come within the scope of the appended claims and their equivalents.

What is claimed is:

1. A storage cabinet, comprising:

a cabinet body with a top opening, an upper cover configured to cover the top opening, and two support elements, wherein:

the two support elements are respectively symmetrically disposed on a left side and a right side of the cabinet body, each of the two support elements is connected between the upper cover and the cabinet body, each of the two support elements comprises a pneumatic bar, an upper cover connector, a cabinet body connector, and a swing piece, the upper cover connector is fixedly connected to a side of the upper cover, the cabinet body connector is fixedly connected to a side of the cabinet body, a first end of the upper cover connector is pivotally connected to a first end of the cabinet body connector, a first end of the swing piece is pivotally connected to the cabinet body connector, two ends of the pneumatic bar are respectively connected to a second end of the swing piece and a second end of the upper cover connector, a pin is disposed on a middle portion of the swing piece, an arc-shaped positioning hole is disposed in the cabinet body connector, and the pin extends from the middle portion of the swing piece and into the arc-shaped positioning hole.

2. The storage cabinet according to claim 1, wherein:

when the pneumatic bar retracts:

the pin moves to an upper end of the arc-shaped positioning hole, and the upper cover closes, and when the pneumatic bar extends:

the pin moves to a lower end of the arc-shaped positioning hole, and the upper cover opens.

3. The storage cabinet according to claim 2, wherein:

the cabinet body connector of a first support element of the two support elements is disposed on a rear end of an upper edge of a left board of the cabinet body and the cabinet body connector of a second support element of the two support elements is disposed on a rear end of an upper edge of a right board of the cabinet body, a rear end of the cabinet body connector extends backward to a back side of a rear board of the cabinet body to define a transition portion, and the transition portion is pivotally connected to the upper cover connector.

4. The storage cabinet according to claim 3, wherein the upper cover connector of the first support element is connected to a left side of a frame of the upper cover and the upper cover connector of the second support element is connected to a right side of the frame.

5. The storage cabinet according to claim 1, wherein:

the cabinet body connector of a first support element of the two support elements is disposed on a rear end of an upper edge of a left board of the cabinet body and the cabinet body connector of a second support element of the two support elements is disposed on a rear end of an upper edge of a right board of the cabinet body, a rear end of the cabinet body connector extends backward to a back side of a rear board of the cabinet body to define a transition portion, and the transition portion is pivotally connected to the upper cover connector.

6. The storage cabinet according to claim 5, wherein the upper cover connector of the first support element is connected to a left side of a frame of the upper cover and the upper cover connector of the second support element is connected to a right side of the frame.

7. The storage cabinet according to claim 1, wherein:

the pneumatic bar comprises a housing and a movable rod, a lower end of the housing is pivotally connected to the second end of the swing piece, and an upper end of the movable rod is pivotally connected to the second end of the upper cover connector.

8. The storage cabinet according to claim 1, wherein the pneumatic bar is disposed in the storage cabinet.

9. The storage cabinet according to claim 1, wherein the cabinet body comprises a bottom board, a left board, a right board, a front board, and a rear board.

10. A storage cabinet, comprising:

a cabinet body with a top opening, an upper cover configured to cover the top opening, and two support elements, wherein:

the two support elements are respectively symmetrically disposed on a left side and a right side of the cabinet body, each of the two support elements is connected between the upper cover and the cabinet body, each of the two support elements comprises a pneumatic bar, an upper cover connector, a cabinet body connector, and a swing piece, the upper cover connector is fixedly connected to a side of the upper cover, the cabinet body connector is fixedly connected to a side of the cabinet body, a first end of the upper cover connector is pivotally connected to a first end of the cabinet body connector, a first end of the swing piece is pivotally connected to the cabinet body connector, two ends of the pneumatic bar are respectively connected to a second end of the swing piece and a second end of the upper cover connector, the cabinet body connector of a first support element of the two support elements is disposed on a rear end of an upper edge of a left board of the cabinet body and the cabinet body connector of a second support element of the two support elements is disposed on a rear end of an upper edge of a right board of the cabinet body, a rear end of the cabinet body connector extends backward to a back side of a rear board of the cabinet body to define a transition portion, and the transition portion is pivotally connected to the upper cover connector.

11. The storage cabinet according to claim 10, wherein the upper cover connector of the first support element is connected to a left side of a frame of the upper cover and the upper cover connector of the second support element is connected to a right side of the frame.

12. The storage cabinet according to claim 10, wherein:

the pneumatic bar comprises a housing and a movable rod, a lower end of the housing is pivotally connected to the second end of the swing piece, and an upper end of the movable rod is pivotally connected to the second end of the upper cover connector.

13. The storage cabinet according to claim 10, wherein the pneumatic bar is disposed in the storage cabinet.

14. The storage cabinet according to claim 10, wherein the cabinet body comprises a bottom board, the left board, the right board, a front board, and the rear board.

15. A storage cabinet, comprising:

a cabinet body with a top opening, an upper cover configured to cover the top opening, and two support elements, wherein:

the two support elements are respectively symmetrically disposed on a left side and a right side of the cabinet body, each of the two support elements is connected between the upper cover and the cabinet body, each of the two support elements comprises a pneumatic bar, an upper cover connector, a cabinet body connector, and a swing piece, the upper cover connector is fixedly connected to a side of the upper cover, the cabinet body connector is fixedly connected to a side of the cabinet body, a first end of the upper cover connector is pivotally connected to a first end of the cabinet body connector, a first end of the swing piece is pivotally connected to the cabinet body connector, two ends of the pneumatic bar are respectively connected to a second end of the swing piece and a second end of the upper cover connector, the pneumatic bar comprises a housing and a movable rod, a lower end of the housing is pivotally connected to the second end of the swing piece, and an upper end of the movable rod is pivotally connected to the second end of the upper cover connector.

16. The storage cabinet according to claim 15, wherein the pneumatic bar is disposed in the storage cabinet.

17. The storage cabinet according to claim 15, wherein the cabinet body comprises a bottom board, a left board, a right board, a front board, and a rear board.

* * * * *